US007155926B2

(12) United States Patent
Chae et al.

(10) Patent No.: US 7,155,926 B2
(45) Date of Patent: Jan. 2, 2007

(54) REFRIGERATOR HAVING CROSS FLOW FAN

(75) Inventors: Su-Nam Chae, Jeollabuk-Do (KR); Moo-Youl Kim, Seoul (KR); Joon-Hwan Oh, Gyeonggi-Do (KR); Tae-Hee Lee, Seoul (KR); Kyeong-Yun Kim, Seoul (KR); Jang-Seok Lee, Incheon (KR); Sung Jhee, Seognam (KR); Nam Soo Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/002,291

(22) Filed: Dec. 3, 2004

(65) Prior Publication Data

US 2005/0160760 A1 Jul. 28, 2005

(30) Foreign Application Priority Data

Jan. 28, 2004 (KR) ..... 10-2004-0005484

(51) Int. Cl.
*F25D 19/00* (2006.01)

(52) U.S. Cl. ..... 62/454

(58) Field of Classification Search ..... 62/408, 62/407, 440, 448, 454
See application file for complete search history.

(56) References Cited

U.S. PATENT DOCUMENTS

| | | | | |
|---|---|---|---|---|
| 2,812,642 | A * | 11/1957 | Jacobs | 62/155 |
| 5,715,703 | A * | 2/1998 | Kopf et al. | 62/455 |
| 6,666,043 | B1 | 12/2003 | Lee | |
| 2004/0139762 | A1 | 7/2004 | Seo | |

FOREIGN PATENT DOCUMENTS

| | | | | |
|---|---|---|---|---|
| EP | 0190794 | | 8/1986 | |
| JP | 1-312357 | | 12/1989 | |
| JP | 06094256 | * | 4/1994 | 62/259.1 |
| JP | 11-063788 | | 3/1999 | |
| JP | 2003-121090 | | 4/2003 | |

OTHER PUBLICATIONS

English language abstract of JP 11-063788.
English language abstract of JP 2003-121090.
English language abstract of JP 1-312357.

* cited by examiner

*Primary Examiner*—Melvin Jones
(74) *Attorney, Agent, or Firm*—Greenblum & Bernstein, P.L.C.

(57) ABSTRACT

A refrigerator includes: a refrigerator body having a cooling chamber for storing food items and a mechanic chamber provided at one side thereof; a heat exchanger disposed in the mechanic chamber and performing heat exchanging while a refrigerant passes therethrough; a cross flow fan disposed facing the heat exchanger and blowing air for heat exchange; and a compressor mounted inside the mechanic chamber and compressing a refrigerant. A space for the mechanic chamber can be reduced, and thus, a cooling chamber for keeping food items can be enlarged.

17 Claims, 6 Drawing Sheets

REFRIGERATOR HAVING CROSS FLOW FAN

BACKGROUND OF THE INVENTION

1. Field of the Invention

The present invention relates to a refrigerator having a cross flow fan and, more particularly, to a refrigerator having a large space for keeping food items by reducing a space for a mechanic chamber.

2. Description of the Background Art

FIG. 1 is a side view of a mechanic chamber of a refrigerator in accordance with a conventional art, FIG. 2 is a perspective view of the mechanic chamber of the refrigerator in accordance with the conventional art, and FIG. 3 is a top view of the mechanic chamber of the refrigerator in accordance with the conventional art.

The conventional refrigerator includes: a refrigerator body 102 including a cooling chamber 104 such as a refrigerating chamber for keeping various refrigerating food items and a freezing chamber keeping frozen food items, a door 106 mounted to be opened at a front side of the refrigerator body 102, and a mechanic chamber 108 disposed at a lower portion of a rear side of the refrigerator body 102 and accommodating various components making a refrigerating cycle.

The mechanic chamber 108 includes a compressor 120 for compressing a refrigerant, a heat exchanger 130 for heat exchanging while the refrigerant passes therethrough, and an axial flow fan 140 for forcibly blowing external air toward the heat exchanger 130.

The heat exchanger 130 includes a refrigerant pipe 132 formed bent repeatedly in a channel (U) shape, arranged vertically at equal intervals and passing a refrigerant therethrough, and cooling pins 134 installed among the refrigerant pipe 132 to enlarge a contact area with air passing the refrigerant pipes 132 to enhance heat transmission performance.

Conventionally, as the heat exchanger 130, a fin-tube type heat exchanger making a cubic shape overall is used.

The axial flow fan 140 is disposed to face the heat exchanger 130 and blows air in an axial direction. A driving motor 142 for rotating the axial flow fan 140 is installed at a rear side of the axial flow fan 140.

However, the conventional refrigerator has a problem that since the heat exchange is bent in the channel shape and arranged vertically at equal intervals, making the cubic shape, a wider installation space is required and thus the size of the mechanic chamber 108 is increased.

In addition, as for the axial flow fan 140 used in the conventional art, in order to increase the air volume, the diameter of the fan needs to be increased, but then, the size of the mechanic chamber 108 accommodating the axial flow fan 140 is to be enlarged.

As mentioned above, the conventional refrigerator uses the cubic type heat exchanger 130 and the axial flow fan 140, so a space of the mechanic chamber 108 as much as the width (L) in the inward direction of the refrigerator body is required and thus the cooling chamber 104 is reduced in size.

SUMMARY OF THE INVENTION

Therefore, an object of the present invention is to provide a refrigerator having a cross flow fan capable of reducing a space of a mechanic chamber and thus enlarging a cooling chamber for keeping food items by employing a cross flow fan for blowing air for heat exchange.

To achieve these and other advantages and in accordance with the purpose of the present invention, as embodied and broadly described herein, there is provided a refrigerator including: a refrigerator body having a cooling chamber for storing food items and a mechanic chamber provided at one side thereof; a heat exchanger disposed in the mechanic chamber and performing heat exchanging while a refrigerant passes therethrough; a cross flow fan disposed facing the heat exchanger and blowing air for heat exchange; and a compressor mounted inside the mechanic chamber and compressing a refrigerant.

A housing for accommodating the heat exchanger and the cross flow fan is installed in the mechanic chamber, which includes a heat exchanger housing for housing the heat exchanger and a suction opening formed at one side for sucking air; and a fan housing connected to the heat exchanger housing, housing the cross flow fan to be rotatable and having a discharge passage formed at one side and discharging air.

The mechanic chamber includes a compressor accommodating space for mounting the compressor and a housing accommodation space for installing the housing, the housing accommodation space being smaller in width than the compressor accommodating space.

The heat exchanger includes a refrigerator pipes arranged in two rows and disposed at equal intervals in a width direction of the refrigerator body; cooling fins formed at an outer circumferential surface of the refrigerating pipes; and a support plate installed at upper and lower ends of the refrigerator pipes.

The cross flow fan includes a rotational shaft for rotatably supporting upper and lower ends of the fan accommodating unit; and a blade mounted at an outer circumferential surface of the rotational shaft and blowing air.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

A refrigerator in accordance with the present invention will now be described with reference to the accompanying drawings.

Figure 1:
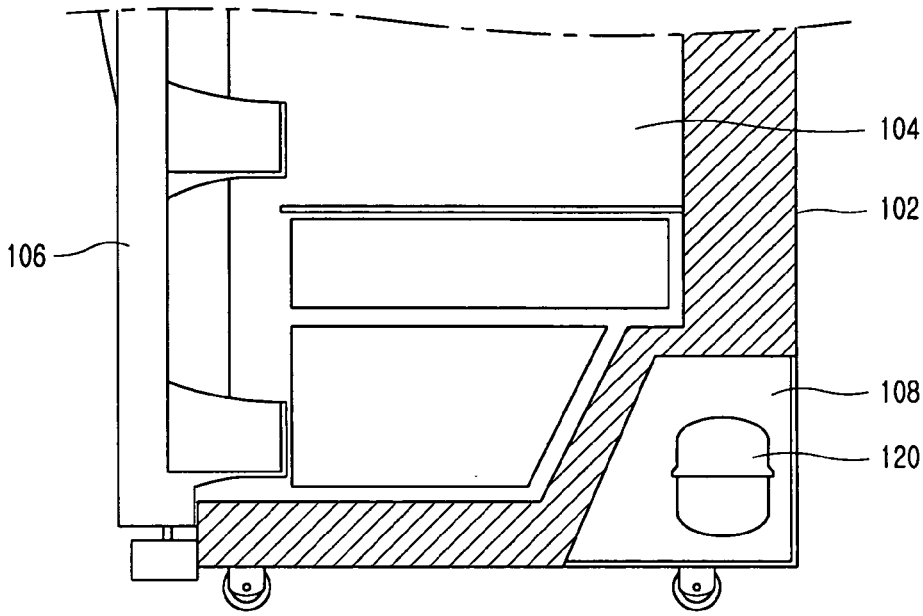
FIG. 1 CONVENTIONAL ART
FIG. 1 is a sectional view of a mechanical chamber of a refrigerator in accordance with a conventional art.
Figure 2:
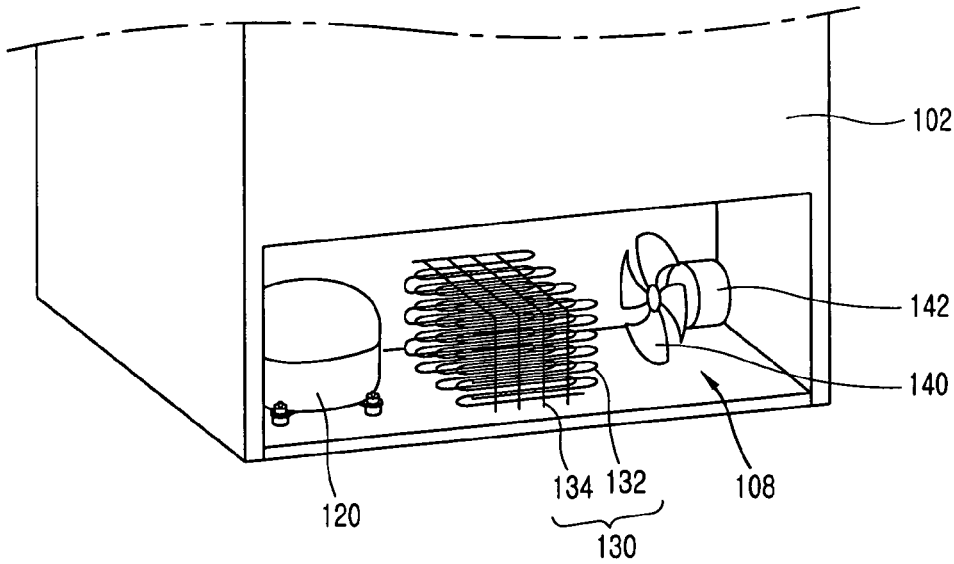
FIG. 2 CONVENTIONAL ART
FIG. 2 is a perspective view of the mechanical chamber of the refrigerator in accordance with the conventional art.
Figure 3:
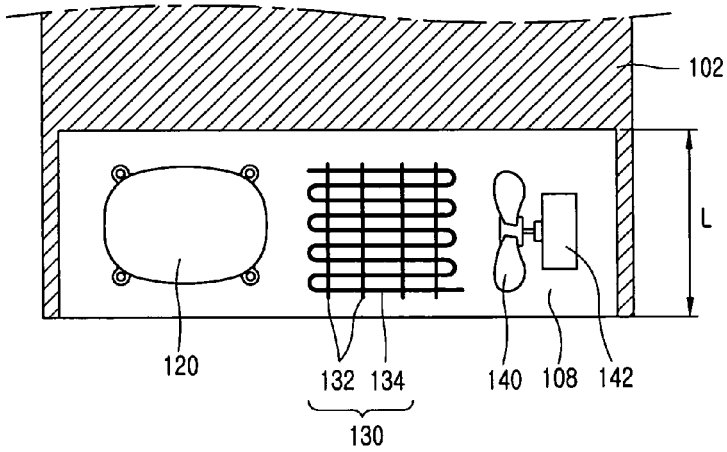
FIG. 3 CONVENTIONAL ART
FIG. 3 is an upper side view of the mechanical chamber of the refrigerator in accordance with the conventional art.
Figure 4:
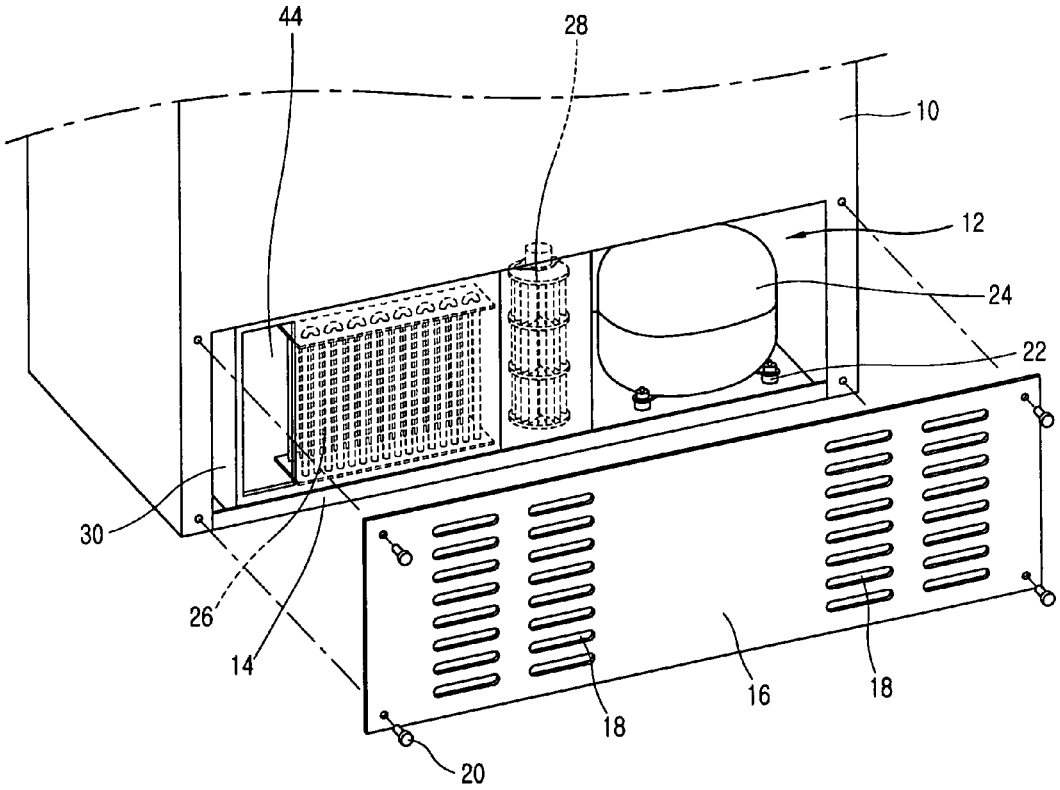
FIG. 4 is a perspective view of a mechanical chamber of a refrigerator in accordance with the present invention.
Figure 5:
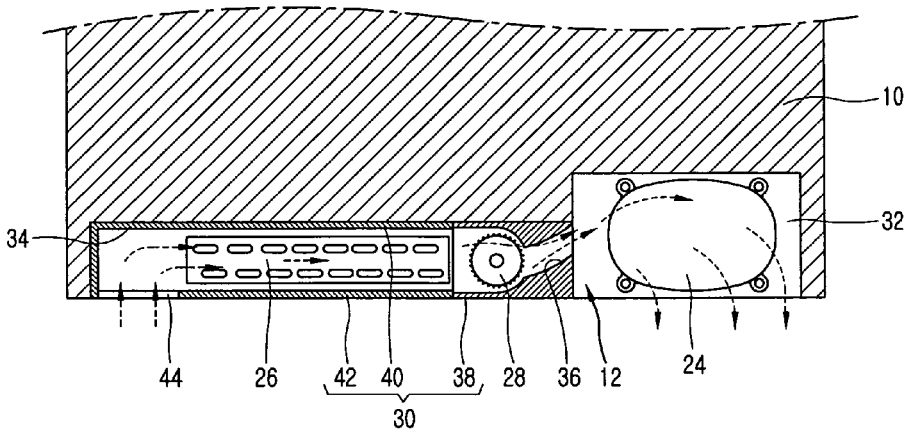
FIG. 5 is an upper side view of the mechanical chamber of the refrigerator in accordance with the present invention.

FIG. 4 is a perspective view of a mechanical chamber of a refrigerator in accordance with the present invention, and FIG. 5 is an upper side view of the mechanical chamber of the refrigerator in accordance with the present invention.

A refrigerator in accordance with the present invention includes: a refrigerator body 10 having a cooling chamber (not shown) such as a freezing chamber for keeping frozen food items and a refrigerating chamber for keeping refrigerating food items; and a mechanic chamber 12 positioned at a lower portion of the refrigerator body 10 and having a certain space to accommodating various elements of a refrigerating cycle.

A base plate 14 is mounted at the lower portion of the refrigerator body 10. The mechanic chamber 12 is disposed to have a certain space at a rear side of the refrigerator body 10. a cover 16 is attached by a bolt to the front side of the mechanic chamber 12. A plurality of air passages 18 is formed in the cover 16 in order to receive external air into the mechanic chamber 12 or discharge air from the mechanic chamber 12 to outside.

The mechanic chamber 12 includes a compressor 24 mounted at an upper surface of the base plate 14, buffered by an anti-vibration member 22, and compressing a refrigerant; a heat exchanger 26 for heat exchanging with external air while the refrigerant passes therethrough; a cross flow fan 28 for forcibly blowing external air to the heat exchanger 26; and a housing 30 for accommodating the heat exchanger 26 and the cross flow fan 28.

The mechanic chamber 12 is divided into a compressor accommodating space 32 so large as to include the compressor 24; and a housing accommodating space 34 smaller in width than the compressor accommodating space 32 and including the housing 30.

Figure 6:
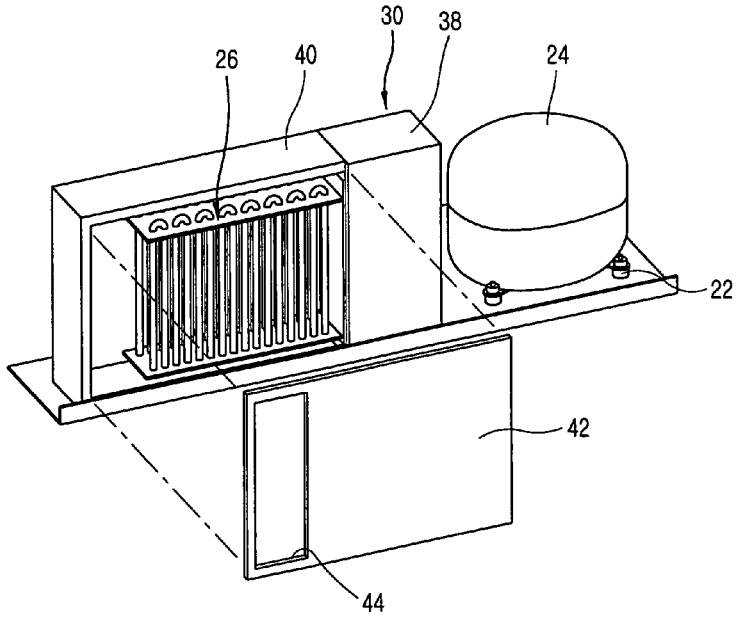
FIG. 6 is a perspective view showing elements installed in the mechanic chamber of the refrigerator in accordance with the present invention.

As shown in FIG. 6, the housing 30 includes a fan housing 38 having a the cross flow fan 28 and discharge passage 36 for discharging air blown by the cross flow fan 28; a heat exchanger housing 40 integrally formed with the fan housing 38 and including the heat exchanger 26; and a housing cover 42 mounted at the front side of the heat exchanger housing 40 and having an air suction opening 44 for sucking air.

Figure 7:
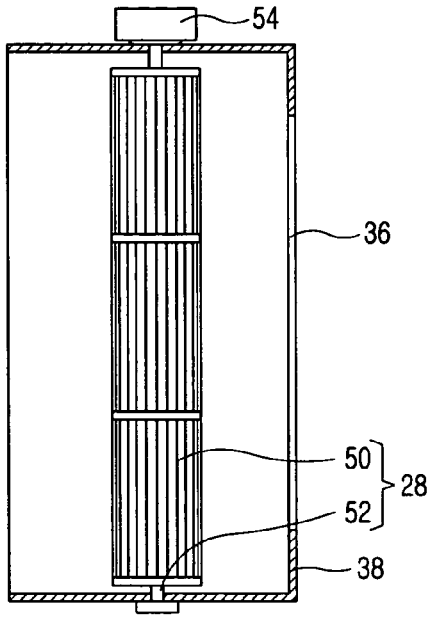
FIG. 7 is a sectional view of a cross flow fan in accordance with one embodiment of the present invention.

With reference to FIG. 7, the cross flow fan 28 includes a rotational shaft 52 vertically disposed inside the fan housing 38 and rotatably mounted at upper and lower ends of the fan housing 38; and a plurality of blades 50 formed at equal intervals in a circumferential direction of the rotational shaft 52. A driving motor 54 connected to the rotational shaft 52 and rotating the cross flow fan 28 is installed at the upper surface of the fan housing 38.

Since the cross flow fan 28 is disposed to be stood in a vertical direction, the accommodating space of the mechanic chamber 12 can be minimized and thus the size of the mechanic chamber 12 can be reduced according to the diameter of the cross flow fan 28.

Figure 8:
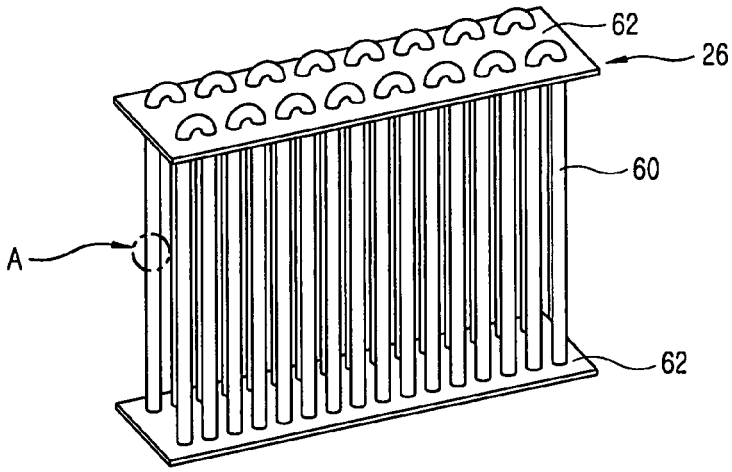
FIG. 8 is a perspective view of a heat exchanger in accordance with one embodiment of the present invention.
Figure 9:
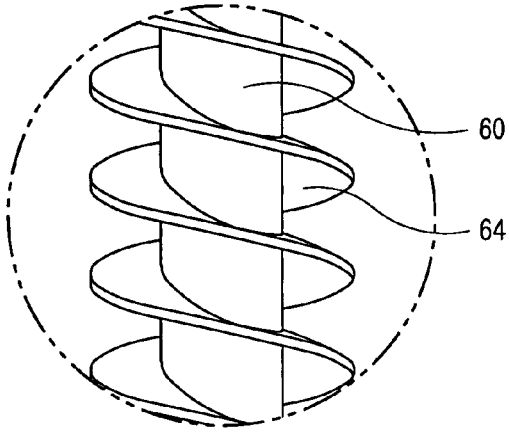
FIG. 9 is an enlarged view of a portion 'A' of FIG. 8.

As shown in FIGS. 8 and 9, the heat exchanger 26 includes a plurality of refrigerant pipes 60 disposed in a state of being stood vertically and passing refrigerant therethrough; cooling fins 64 formed at an outer circumferential surface of the refrigerant pipes 60 to enlarge a contact area with passing air to thereby improve heat exchange performance; and a pair of support plates 62 for supporting upper and lower ends of the refrigerant pipes 60.

The refrigerant pipes 60 are disposed to be stood vertically at equal intervals in a longitudinal direction of the mechanic chamber 12 in two rows in order to minimize the space taken by the refrigerant pipes 60 in the mechanic chamber 12. The cooling fins 64 are formed in a screw form at the outer circumferential surface of the refrigerant pipes 60.

The refrigerator in accordance with the present invention constructed as described above operates as follows.

When the refrigerator is turned on, the compressor 24 is driven to compress the refrigerant, and as the cross flow fan 28 is rotated according to driving of the driving motor 54, external air is sucked through the suction opening 44 and passes the heat exchanger 26 so as to be heat exchanged with the refrigerant passing through the refrigerant pipe 60 of the heat exchanger 26. The heat exchanged air while passing the heat exchanger 26 passes the cross flow fan 28 and then is discharged toward the compressor 24 through the discharge passage 36 formed in the housing 38, thereby cooling the compressor 24.

In the refrigerator, since the cross flow fan 28 is vertically disposed in the mechanic chamber 12 and the refrigerant pipes 60 of the heat exchanger 26 are vertically disposed in two rows, the space of the mechanic chamber 12 can be reduced and thus the cooling chamber for keeping food items can be enlarged.

Figure 10:
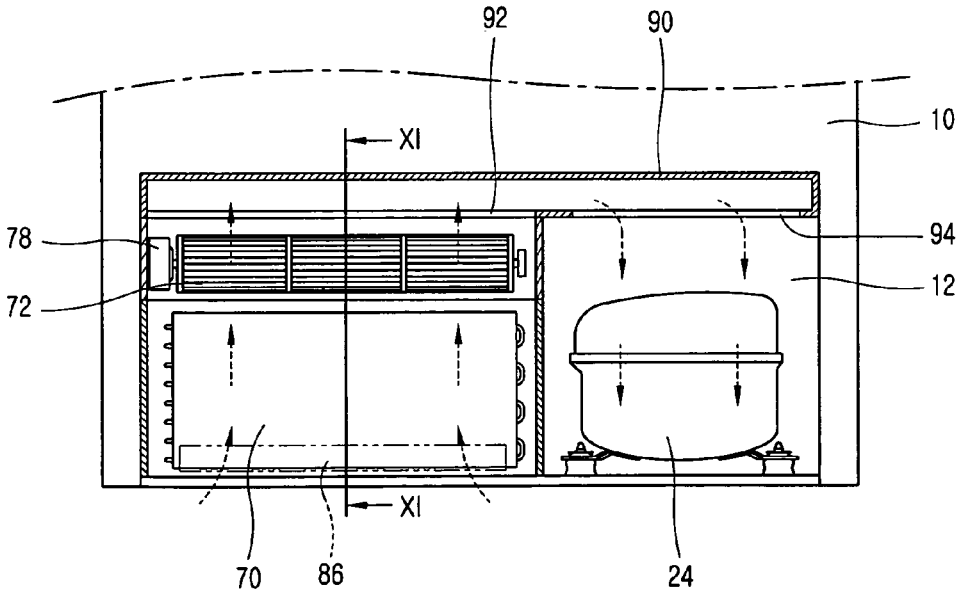
FIG. 10 is a side view of a mechanic chamber in accordance with another embodiment of the present invention.
Figure 11:
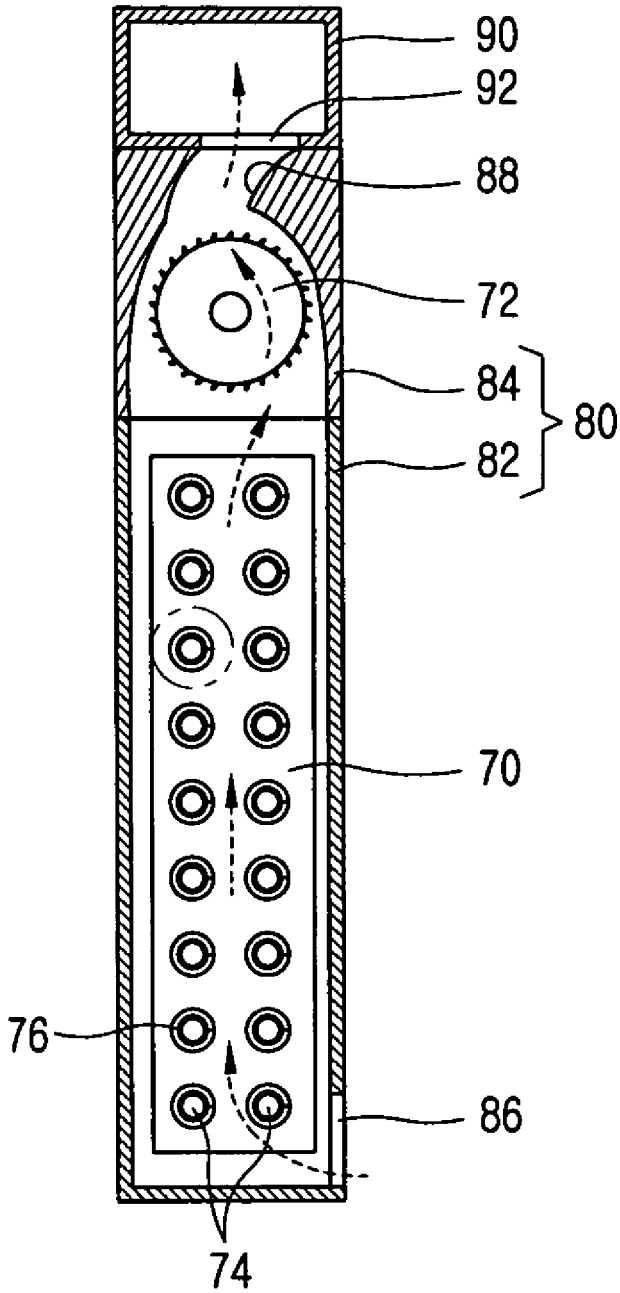
FIG. 11 is a sectional view taken along line XI—XI of FIG. 10.

FIG. 10 is a side view of a mechanic chamber in accordance with another embodiment of the present invention, and FIG. 11 is a sectional view taken along line XI—XI of FIG. 10.

A refrigerator in accordance with another embodiment of the present invention is constructed such that a compressor 24 is installed at one side in the mechanic chamber 12, a heat exchanger 70 is disposed at the side of the compressor 24 in a width direction of a refrigerator body 10, and a cross flow fan 72 is installed at an upper side of the heat exchanger 70. A housing 80 for housing the cross flow fan 72 and the heat exchanger 70 is installed in the mechanic chamber 12.

In the heat exchanger 70, the refrigerant pipe 74 arranged in 2 rows are disposed horizontally in a length direction of the mechanic chamber 12, and cooling fins 76 in a screw form are formed at the outer circumferential surface of the refrigerant pipe 74 to enlarge a contact area with air.

The cross flow fan 72 has the same construction as the cross flow fan 28 as mentioned above in the first embodiment, and disposed to be horizontal to the heat exchanger 70 at the upper side of the heat exchanger 70, Namely, a driving motor 78 is installed at one side of the cross flow fan 72 and horizontally disposed at the upper side of the mechanic chamber 12.

The housing 80 includes a heat exchanger housing 82 in which the heat exchange 70 is inserted and a suction opening 86 is formed to suck air, and a fan housing 84 connected to the heat exchanger housing 82, in which the cross flow fan 72 is installed and a discharge passage 88 for discharging air that has passed the cross flow fan 72 is formed at the upper side.

An air guide 90 is installed at the upper side of the mechanic chamber 12 in order to guide air discharged from the discharge passage 88 of the fan housing 84 to the compressor 24 to cool the compressor 24. The air guide 90 includes an air inlet 92 formed at one side thereof and communicating with the discharge passage 88 formed in the fan housing 84 and an air outlet .94 formed at the other side and discharging air toward the compressor 24.

The refrigerator in accordance with another embodiment of the present invention constructed as described above operates as follows.

When the refrigerator is turned on, the compressor 24 is driven to compress the refrigerant, and as the driving motor 78 is driven, the cross flow fan 72 is rotated to generate a blowing force.

Then, external air is sucked through the suction opening 86 formed at the heat exchange housing 82 and passes the heat exchanger 70, heat exchanging with the refrigerant passed through the refrigerant pipes 74. The air that has passed the heat exchanger 70 is discharged through the discharge passage 88 formed in the fan housing 84, sucked through the air inlet 92 of the air guide 90, passes through the air guide 90, and then discharged to the compressor 24 through the air outlet 94 of the air guide 90, thereby cooling the compressor 24.

As so far described, the refrigerator having the cross flow fan has the following advantages.

That is, for example, since the cross flow fan is used to blow air for heat exchange, the space of the mechanic chamber can be reduced, and thus, the cooling chamber for keeping frozen foods can be enlarged.

In addition, since the refrigerant pipes arranged in two rows are disposed at equal intervals in a vertical or horizontal direction in the heat exchanger used for the refrigerator, the space of the mechanic chamber can be reduced, and thus, the cooling chamber for receiving food items can be also enlarged.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator, comprising:

a refrigerator body having a cooling chamber for storing food items and a mechanic chamber provided at one side thereof;

a heat exchanger disposed in the mechanic chamber and performing heat exchanging while a refrigerant passes therethrough;

a cross flow fan disposed in said mechanic chamber proximate said heat exchanger, said cross flow fan being oriented relative to said heat exchanger to minimize a size requirement of said mechanic chamber; and a compressor mounted inside the mechanic chamber and compressing a refrigerant.

2. The refrigerator of claim 1, further comprising a housing installed in the mechanic chamber, in which the heat exchanger and the cross flow fan are inserted.

3. The refrigerator of claim 2, wherein the housing comprises:

a heat exchanger housing that houses the heat exchanger and has a suction opening formed at one side of the heat exchanger housing for sucking air; and a fan housing connected to the heat exchanger housing, housing the cross flow fan, the fan housing having a discharge passage formed at one side of the fan housing for discharging air.

4. The refrigerator of claim 2, wherein the mechanic chamber includes a compressor accommodating space that accommodates the compressor and a housing accommodation space that accommodates the housing, the housing accommodation space being smaller in width than the compressor accommodating space.

5. The refrigerator of claim 1, wherein the heat exchanger comprises:

refrigerator pipes arranged in two rows and disposed at equal intervals in a width direction of the refrigerator body;

cooling fins formed along an outer circumferential surface of the refrigerating pipes; and support plates provided at upper and lower ends of the refrigerator pipes.

6. The refrigerator of claim 5, wherein the cooling fins are formed in a screw-like fashion along the outer circumferential surface of the refrigerating pipes.

7. The refrigerator of claim 1, wherein the cross flow fan is positioned between the heat exchanger and the compressor and has a rotational axis extending in a vertical direction.

8. The refrigerator of claim 3, wherein the cross flow fan comprises:

a rotational shaft rotatably supported at upper and lower ends of the fan housing; and at least one blade provided on an outer circumferential surface of the rotational shaft.

9. A refrigerator, comprising:

a refrigerator body having a cooling chamber for keeping food items and a mechanic chamber provided at one side thereof;

a compressor disposed at one side of the mechanic chamber and compressing a refrigerant;

a heat exchanger disposed at another side of the mechanic chamber and having refrigerant pipes disposed at equal intervals in a horizontal directional;

a cross flow fan disposed above the heat exchanger and having a rotational axis extending in a horizontal direction; and a housing installed in the mechanic chamber, in which the heat exchanger and the cross flow fan are inserted.

10. The refrigerator of claim 9, wherein the refrigerant pipes are arranged in two rows horizontally disposed in a width direction of the refrigerator body, and cooling fins are formed along an outer circumferential surface of the refrigerant pipes.

11. The refrigerator of claim 9, wherein the housing comprises:

a heat exchanger housing that houses the heat exchanger and has a suction opening formed at one side of the heat exchanger housing for sucking air; and a fan housing connected to the heat exchanger housing, housing the cross flow fan, the fan housing having a discharge passage formed at one side of the fan housing for discharging air.

12. The refrigerator of claim 11, further comprising:

an air guide provided at an upper side of the mechanic chamber that guides air discharged through the discharge passage formed in the fan housing to cool the compressor.

13. The refrigerator of claim 12, wherein the air guide is disposed in a width direction of the refrigerator body at the upper side of the mechanic chamber, an air inlet communicating with the discharge passage formed in the fan housing and receiving air therethrough is formed at one side of the air guide, and an air discharge opening for discharging air to the compressor is formed at the other side of the air guide.

14. A refrigerator, comprising:

a mechanic chamber;

a heat exchanger disposed in said mechanic chamber; and a cross flow fan disposed in said mechanic chamber proximate said heat exchanger, said cross flow fan being oriented relative to said heat exchanger to minimize a size requirement of said mechanic chamber, a rotational axis of said cross flow fan extending in a vertical direction.

15. The refrigerator of claim 14, wherein the cross flow fan is oriented such that its largest dimension does not extend in a width direction of the refrigerator.

16. The refrigerator of claim 14, wherein the heat exchanger comprises refrigerant pipes, and the refrigerant pipes do not extend in a width direction of the refrigerator.

17. The refrigerator of claim 14, wherein cooling fins are formed along an outer circumferential surface of the refrigerating pipes.

* * * * *